US007737092B2

(12) United States Patent
Ward, Jr. et al.

(10) Patent No.: US 7,737,092 B2
(45) Date of Patent: Jun. 15, 2010

(54) CONTINUOUSLY VARIABLE TRANSMISSION FLUIDS COMPRISING A COMBINATION OF CALCIUM-AND MAGNESIUM-OVERBASED DETERGENTS

(75) Inventors: William C. Ward, Jr., Perry, OH (US); Carlos L. Cerda de Groote, Lakewood, OH (US); Masahiko Ikeda, Aichi (JP); Denise R. Vermilya, Lakewood, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 888 days.

(21) Appl. No.: 10/513,520

(22) PCT Filed: May 7, 2003

(86) PCT No.: PCT/US03/14354

§ 371 (c)(1),
(2), (4) Date: Nov. 4, 2004

(87) PCT Pub. No.: WO03/095595

PCT Pub. Date: Nov. 20, 2003

(65) Prior Publication Data

US 2005/0176593 A1 Aug. 11, 2005

(51) Int. Cl.

| | |
|---|---|
| ***C10M 141/10*** | (2006.01) |
| ***C10M 137/10*** | (2006.01) |
| ***C10M 159/08*** | (2006.01) |
| ***C10L 1/22*** | (2006.01) |

(52) U.S. Cl. ..... 508/162; 508/164; 508/486; 508/371; 508/551

(58) Field of Classification Search ..... 508/162, 508/164, 486, 371, 551
See application file for complete search history.

(56) References Cited

U.S. PATENT DOCUMENTS

| | | | | |
|---|---|---|---|---|
| 5,750,477 | A * | 5/1998 | Sumiejski et al. | 508/331 |
| 5,759,965 | A | 6/1998 | Sumiejski | 508/186 |
| 5,773,391 | A | 6/1998 | Lawate et al. | 508/257 |
| 5,851,962 | A | 12/1998 | Kaga | 508/162 |
| 5,854,182 | A * | 12/1998 | Swami et al. | 508/186 |
| 5,962,378 | A * | 10/1999 | Tiffany et al. | 508/293 |
| 6,114,288 | A * | 9/2000 | Fujitsu et al. | 508/371 |
| 6,268,316 | B1 * | 7/2001 | Tanaka et al. | 508/291 |
| 2001/0036906 | A1 * | 11/2001 | Locke et al. | 508/192 |
| 2002/0151441 | A1 * | 10/2002 | Srinivasan et al. | 508/188 |
| 2003/0013619 | A1 * | 1/2003 | Sato et al. | 508/192 |

FOREIGN PATENT DOCUMENTS

| | | |
|---|---|---|
| EP | 753 564 | 1/1997 |
| EP | 798 367 | 10/1997 |
| JP | 2000-063869 | 2/2002 |
| WO | WO 00/70001 | 11/2000 |

OTHER PUBLICATIONS

Machine Translation of JP 2000-063869.
Abstract of JP 2000-063869, Patent Abstracts of Japan.

* cited by examiner

*Primary Examiner*—Walter D Griffin
*Assistant Examiner*—Frank C Campanell
(74) *Attorney, Agent, or Firm*—David M. Shold; Christopher D. Hilker

(57) ABSTRACT

A composition suitable for use as a lubricant for a transmission includes an oil of lubricating viscosity; a dispersant; a calcium detergent; a magnesium detergent; and an inorganic phosphorus compound. At least one of the dispersant or detergent components is borated.

13 Claims, No Drawings

CONTINUOUSLY VARIABLE TRANSMISSION FLUIDS COMPRISING A COMBINATION OF CALCIUM-AND MAGNESIUM-OVERBASED DETERGENTS

BACKGROUND OF THE INVENTION

The present invention relates to formulations suitable for use as fluids for transmissions, especially continuously variable transmissions.

Continuously variable transmissions (CVT) represent a radical departure from conventional automatic transmissions. The push belt version of the CVT was invented by Dr. Hub Van Doorne, and since its introduction, many cars have been equipped with the push belt CVT system. CVT push belts are manufactured by Van Doorne's Transmissie VB of Tilburg, the Netherlands. A more detailed description of such transmissions and belts and lubricants employed therein is found in European Patent Application 753 564, published Jan. 15, 1997, as well as references cited therein. In brief, a belt and pulley system is central to the operation of this type of transmission. The pulley system comprises a pair of pulleys with a V-shaped cross-section, each consisting of a moveable sheave, a fixed sheave, and a hydraulic cylinder. Between the pulleys runs a belt, which consists of a set of metal elements held together by metal bands. In operation, the driving pulley pushes the belt to the driven pulley, thereby transferring power from the input to the output. The transmission drive ratio is controlled by opening or closing the moveable sheaves so that the belt rides lower or higher on the pulley faces. This manner of operation permits continuous adjustment of gear ratio between the input and output shafts.

It has become clear from commercial use of the CVT that the fluids used in the CVT are just as important as the mechanical design for satisfactory operation. The lubricant must fulfill several functions: to lubricate the metal belt in its contacts with the pulley assembly, the planetary and other gears, the wet-plate clutches, and the bearings; to cool the transmission; and to carry hydraulic signals and power. The hydraulic pressure controls the belt traction, transmission ratio, and clutch engagement. The lubricant must provide the appropriate degree of friction between the belt and pulley assembly, to avoid the problem of slippage on one hand, and binding on the other, all the while providing protection to the metal surfaces from pitting, scuffing, scratching, flaking, polishing, and other forms of wear. Accordingly, the fluid should maintain a relatively high coefficient of friction for metal/metal contact, as well as exhibiting a suitable degree of shear stability.

PCT Patent Application WO 00/70001, November, 2000, discloses formulations suitable for use as fluids for continuously variable transmissions, comprising (a) an oil of lubricating viscosity; and (b) a dispersant; or (c) a detergent; or mixtures of (b) and (c), wherein at least one of the dispersant (b) and the detergent (c) is a borated species and wherein the amount of boron supplied to the formulation is sufficient to impart improved friction and anti-seizure properties to said formulation.

U.S. Pat. No. 5,759,965, Sumiejski, Jun. 2, 1998, discloses antiwear enhancing composition for lubricants and functional fluids. It includes a boron-containing overbased material, a phosphorus acid, ester, or derivative, and a borated epoxide or borated fatty acid ester, and optionally a thiocarbamate.

The metal-metal coefficient of friction and the antiseizure properties of CVT fluids are important performance parameters for the effective application of continuously variable transmissions. The present invention solves the problem of providing a suitable CVT fluid with exceptional metal-metal friction and good antiseizure properties. The formulations exhibit both a high dynamic coefficient of friction (metal on metal) and a positive slope in the plot of dynamic friction versus sliding speed.

The compositions of the present invention can also be used as lubricating oils and greases useful in other industrial applications and in automotive engines, transmissions and axles. These compositions are effective in a variety of applications including crankcase lubricating oils for spark-ignited and compression-ignited internal combustion engines, including automobile and truck engines, two-cycle engines, aviation piston engines, marine and low-load diesel engines, and the like. They are also useful as additives for traction fluids. Also, automatic transmission fluids, manual transmission fluids, transaxle lubricants, gear lubricants, metalworking lubricants, hydraulic fluids, and other lubricating oil and grease compositions can benefit from the incorporation of the compositions of this invention. The inventive functional fluids are particularly effective as automatic transmission fluids, particularly fluids for continuously variable transmissions, including push-belt type and toroidal traction drive transmissions, as well as dual clutch transmissions.

SUMMARY OF THE INVENTION

The present invention provides a composition suitable for use as a lubricant for a transmission, comprising:

(a) an oil of lubricating viscosity;

(b) a dispersant;

(c) calcium detergent;

(d) a magnesium detergent; and (e) an inorganic phosphorus compound;

wherein at least one of (b), (c), and (d) is borated.

The present invention further provides a method for lubricating a transmission, comprising imparting to said transmission the aforedescribed formulation.

DETAILED DESCRIPTION OF THE INVENTION

Various preferred features and embodiments will be described below by way of non-limiting illustration.

The first component of the present invention is (a) an oil of lubricating viscosity which is generally present in a major amount (i.e. an amount greater than 50% by weight). Generally, the oil of lubricating viscosity is present in an amount of greater than 80% by weight of the composition, typically at least 85%, preferably 90 to 95%. Such oil can be derived from a variety of sources, and includes natural and synthetic lubricating oils and mixtures thereof.

The natural oils useful in making the inventive lubricants and functional fluids include animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinic/naphthenic types which may be further refined by hydrocracking and hydrofinishing processes and are dewaxed. Oils of lubricating viscosity derived from coal or shale are also useful. Useful natural base oils may be those designated by the American Petroleum Institute (API) as Group I, II, or III oils. Group I oils contain <90% saturates and/or >0.03% sulfur and have a viscosity index (VI) of ≧80. Group II oils contain ≧90% saturates, ≦0.03% sulfur, and have a VI≧80. Group III oils are similar to group II but have a VI≧120.

Upon occasion, highly refined or hydrocracked natural oils have been referred to as "synthetic" oils. More commonly, however, synthetic lubricating oils are understood to include hydrocarbon oils and halo-substituted hydrocarbon oils such as polymerized and interpolymerized olefins (e.g., polybutylenes, polypropylenes, propylene-isobutylene copolymers, chlorinated polybutylenes); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof and the like. Poly-alpha olefin oils are also referred to as API Group IV oils.

In one embodiment, the oil of lubricating viscosity is a poly-alpha-olefin (PAO). Typically, the poly-alpha-olefins are derived from monomers having from 4 to 30, or from 4 to 20, or from 6 to 16 carbon atoms. Examples of useful PAOs include those derived from 1-decene. These PAOs may have a viscosity from 2 to 150.

Preferred base oils include poly-α-olefins such as oligomers of 1-decene. These synthetic base oils are hydrogenated resulting in an oil of stability against oxidation. The synthetic oils may encompass a single viscosity range or a mixture of high viscosity and low viscosity range oils so long as the mixture results in a viscosity which is consistent with the requirements set forth below. Also included as preferred base oils are highly hydrocracked and dewaxed oils. These petroleum oils are generally refined to give enhanced low temperature viscosity and antioxidation performance. Mixtures of synthetic oils with refined mineral oils may also be employed.

Another class of oils is known as traction oils, which are typically synthetic fluids containing a large fraction of highly branched or cycloaliphatic structures, i.e., cyclohexyl rings. Traction oils or traction fluids are described in detail, for example, in U.S. Pat. Nos. 3,411,369 and 4,704,490.

Other suitable oils can be oils derived from a Fischer-Tropsch process and hydrogenation.

(b) Another component of the present invention is a dispersant, preferably a borated dispersant. Dispersants which can be used in the present invention, and borated if desired, include succinimide dispersants, ester dispersants, ester-amide dispersants, Mannich dispersants, alkyl amino phenol dispersants, polyalkene-acrylic acid dispersant, polyether dispersants, and condensation products of fatty hydrocarbyl monocarboxylic acylating agents with an amine or ammonia. Dispersants of these and other types are well known in the technology of lubricant additives. Besides boration, such dispersants can also be post-treated by reaction with any one or more of a variety of agents. Among these are urea, thiourea, dimercaptothiadiazoles, carbon disulfide, aldehydes, ketones, carboxylic acids, hydrocarbon-substituted succinic anhydrides, nitriles, epoxides, and phosphorus compounds. Thus, the dispersant can also be a phosphorylated borated dispersant. References detailing such treatment are listed in U.S. Pat. No. 4,654,403.

Succinimide dispersants include reaction products of one or more hydrocarbyl-substituted succinic acids, anhydride, or reactive equivalents thereof, with one or more amines. Succinimide dispersants have a variety of chemical structures including typically

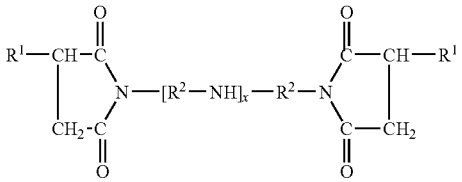

where each $R^1$ is independently an alkyl group, frequently a polyisobutyl group with a molecular weight of 500-5000, optionally substituted with multiple succinic groups. $R^2$ are alkylenel groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. The structure will, of course, also vary as the type of polyamine varies. Succinimide dispersants are more fully described in U.S. Pat. Nos. 4,234,435 and 3,172,892.

The polyamine which reacts with the succinic acylating agent can be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

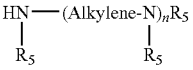

wherein n typically has an average value from 1 to 4 or 6 to and the "Alkylene" group typically has from 1 to 10 carbon atoms. Each $R_5$ is independently hydrogen, or an aliphatic or hydroxy-substituted aliphatic group of up to 30 carbon atoms.

Such alkylenepolyamines include methylenepolyamines, ethylenepolyamines, butylenepolyamines, propylenepolyamines, pentylenepolyamines, etc. The higher homologs and related heterocyclic amines such as piperazines and N-aminoalkyl-substituted piperazines are also included. Specific examples of such polyamines are ethylenediamine, diethylenetriamine (DETA), triethylenetetramine (TETA), tris-(2-aminoethyl)amine, propylenediamine, trimethylenediamine, tripropylenetetramine, tetraethylenepentamine, hexaethyleneheptamine, and pentaethylenehexamine.

Ethylenepolyamines and their preparation are described in detail under the heading Ethylene Amines in Kirk Othmer's "Encyclopedia of Chemical Technology", 2d Edition, Vol. 7, pages 22-37, Interscience Publishers, New York (1965).

Other useful types of polyamine mixtures are those resulting from stripping of the above-described polyamine mixtures to leave as residue what is often termed "polyamine bottoms". Another useful polyamine is a condensation reaction between at least one hydroxy compound with at least one polyamine reactant containing at least one primary or secondary amino group. The hydroxy compounds are preferably polyhydric alcohols and amines. The amine condensates and methods of making the same are described in U.S. Pat. No. 5,053,152.

In another embodiment, the polyamines are hydroxy-containing polyamines; in another embodiment, the amine is a heterocyclic polyamine.

The reaction products of hydrocarbyl-substituted succinic acylating agents and amines and methods for preparing the same are described in U.S. Pat. Nos. 4,234,435; 4,952,328; 4,938,881; 4,957,649; and 4,904,401.

Ester dispersants are similar to the succinimide dispersants, described above, except that they may be seen as having been prepared by reaction of a hydrocarbyl acylating agent (such as a hydrocarbyl succinic anhydride) and a polyhydric aliphatic alcohol such as glycerol, pentaerythritol, or sorbitol. Such materials are described in more detail in U.S. Pat. No. 3,381,022. Likewise, esteramide dispersants are similar to succinimide dispersants except that they can be prepared from amino alcohols or mixtures of amines an alcohols such that the product will contain both ester and amide functionality.

Another class of dispersant is Mannich dispersants, also known as Mannich bases. These are materials which are formed by the condensation of a higher molecular weight, alkyl substituted phenol, an alkylene polyamine, and an aldehyde such as formaldehyde. Such materials may have the general structure

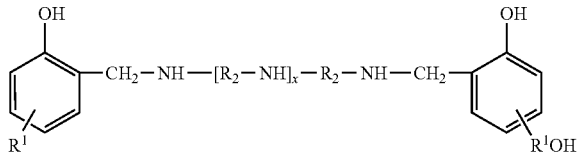

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer. The polar functionality can be in the form of amino functionality. The polymer- or hydrocarbyl-substituted amines can be formed by heating a mixture of a chlorinated olefin or polyolefin such as a chlorinated polyisobutylene with an amine such as ethylenediamine in the presence of a base such as sodium carbonate as described in U.S. Pat. No. 5,407,453. Similarly, other functionality can be imparted, such as carboxylic acid functionality (by reaction with an acid such as acrylic acid.) If the hydrocarbon-based polymer is of a suitable molecular weight to be a viscosity modifier, the resulting material can be referred to as a dispersant viscosity modifier.

The dispersant can also be a condensation product of a fatty hydrocarbyl monocarboxylic acylating agent, such as a fatty acid, with an amine or ammonia. The hydrocarbyl portion of the fatty hydrocarbyl monocarboxylic acylating agent can be an aliphatic group, which can be linear or branched, saturated, unsaturated, or a mixture thereof. The aliphatic group can have 1 to 50 carbon atoms, preferably 8, 10, or 12 to 20 carbon atoms. The acylating agent can be an aliphatic carboxylic acid comprising a carboxy group (COOH) and an aliphatic group. The monocarboxylic acylating agent can be a monocarboxylic acid or a reactive equivalent thereof, such as an anhydride, an ester, or an acid halide such as stearoyl chloride. Useful monocarboxylic acylating agents are available commercially from numerous suppliers and include tall oil fatty acids, oleic acid, stearic acid and isostearic acid. Fatty acids containing 12 to 24 carbon atoms, including C18 acids, are particularly useful. The amine can be any of the amines described above.

Alkyl amino phenol dispersants are hydrocarbyl-substituted aminophenols. The hydrocarbyl substituent of the aminophenol can have 10 to 400 carbon atoms. The hydrocarbyl substituent can be derived from an olefin or a polyolefin, as described above in connection with the Mannich dispersant. The hydrocarbyl-substituted aminophenol can have one or more amino groups. The hydrocarbyl-substituted aminophenol can be prepared by alkylating phenol with an olefin or a polyolefin, nitrating the alkylated phenol with a nitrating agent such as nitric acid, and reducing the nitrated phenol with a reducing agent as described in U.S. Pat. No. 4,724,091.

Polyether dispersants include polyetheramines, polyether amides, polyether carbamates, and polyether alcohols. Polyetheramines can be represented by the formula $R[OCH_2CH(R^1)]_nA$, where R is a hydrocarbyl group, $R^1$ is hydrogen or a hydrocarbyl group of 1 to 16 carbon atoms, or mixtures thereof, n is 2 to 50, and A can be $—OCH_2CH_2CH_2NR^2R^2$ or $—NR^3R^3$, where each $R^2$ is independently hydrogen or hydrocarbyl and each $R^3$ is independently hydrogen, hydrocarbyl, or an alkyleneamine group. Polyetheramines and their methods of preparation are described in greater detail in U.S. Pat. No. 6,458,172, columns 4 and 5. Polyether alcohols include hydrocarbyl-terminated poly(oxyalkylene) monools, including the hydrocarbyl-terminated poly(oxypropylene) monools described in greater detail in U.S. Pat. No. 6,348,075; see in particular column 8. The hydrocarbyl group can be an alkyl or alkyl-substituted aromatic group of 8 to 20 carbon atoms, such as $C_{12-16}$ alkyl or nonylphenyl.

The dispersant is, in one embodiment, a borated dispersant. Typically, the borated dispersant contains from 0.1% to 5%, or from 0.5% to 4%, or from 0.7% to 3% by weight boron. Borated dispersants are described in U.S. Pat. Nos. 3,000,916; 3,087,936; 3,254,025; 3,282,955; 3,313,727; 3,491,025; 3,533,945; 3,666,662, 4,925,983 and 5,883,057. They are prepared by reaction of one or more dispersants with one or more boron compounds.

Suitable boron compounds for preparing borated dispersants include various forms of boric acid (including metaboric acid, $HBO_2$, orthoboric acid, $H_3BO_3$, and tetraboric acid, $H_2B_4O_7$), boric oxide, boron trioxide, and alkyl borates of the formula $(RO)_xB(OH)_y$ wherein x is 1 to 3 and y is 0 to 2, the sum of x and y being 3, and where R is an alkyl group containing 1 to 6 carbon atoms. In one embodiment, the boron compound is an alkali or mixed alkali metal and alkaline earth metal borate. These metal borates are generally hydrated particulate metal borates which are known in the art. Alkali metal borates include mixed alkali and alkaline metal borates. These metal borates are available commercially.

The dispersant can also be a mixture of one or more borated dispersants with one or more non-borated dispersants.

The amount of the dispersant, on an oil free basis, in the fully formulated fluids of the present invention can be 0.5 to 6 percent by weight, preferably 1 to 4 or 2 to 3 percent by weight. The dispersant can contribute 50 to 3000 parts per million (ppm) boron, preferably 80 to 1500 ppm, and more preferably 150, 200, 250, or 500 ppm to 1200 ppm boron, to the fully formulated fluid.

Another required component of the present invention is a combination of two detergents (c) a calcium detergent and (d) a magnesium detergent, which are typically in the form of overbased metal salts. Overbased materials are generally single phase, homogeneous Newtonian systems characterized by a metal content in excess of that which would be present for neutralization according to the stoichiometry of the metal and the particular acidic organic compound reacted with the metal. The overbased materials are most commonly prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, or xylene) for said acidic organic material, a stoichiometric excess of a metal base, and a promoter such as a phenol or alcohol. The detergent components of the present additive mixture can be one or more borated or non-borated overbased salts of a sulfonic acid, phenol, salicylic acid, glyoxylic acid, carboxylic acid, or phosphorus-containing acid, or mixtures thereof. The term "salicylate" is used herein, as commonly in the art, to preferably mean salts of hydrocarbyl-substituted salicylic acid.

Sulfonate salts, which are among those preferred, are those having a substantially oleophilic character and which are formed from organic materials. Organic sulfonates are well known materials in the lubricant and detergent arts. The sulfonate compound should contain on average 10 to 40 carbon atoms, preferably 12 to 36 and more preferably 14 to 32 carbon atoms. While the carbon atoms can be either in an aromatic or paraffinic configuration, it is preferred that alkylated aromatics be used. While naphthalene based materials can be used, the preferred aromatic materials are based on benzene.

A preferred composition includes an overbased hydrocarbylbenzenesulfonate, typically an alkyl sulfonate, such as a monosulfonated alkylated benzene, preferably the monoalkylated benzene. Typically, alkyl benzene fractions are obtained from still bottom sources and are mono- or di-alkylated. A mixture of mono-alkylated aromatics can be used to obtain the mono-alkylated salt (benzene sulfonate). Mixtures in which a substantial portion of the composition contains polymers of propylene as the source of the alkyl groups assist in the solubility of the salt in the transmission fluids of the present invention.

In one embodiment, the overbased calcium detergent can be an overbased calcium hydrocarbylsalicylate. In one embodiment the overbased magnesium detergent can be an overbased magnesium hydrocarbylphenate.

The detergent is typically overbased. By overbasing, it is meant that a stoichiometric excess of the metal be present, beyond that required to neutralize the anion of the salt. The excess metal from overbasing has the effect of neutralizing acids which may build up in the lubricant. The overbasing is generally done such that the metal ratio is at least 1.05:1 or 1.1:1, preferably 2:1 to 30:1, and most preferably 4:1 to 25:1. The metal ratio is the ratio of metal ions, on an equivalent basis, to the anionic portion (i.e, the sulfonate, phenate, salicylate or other such materials as described above) of the overbased material. The above-identified metal ratios can apply to both the calcium detergent and the magnesium detergent.

Preferably the overbased materials are carbonated materials. Carbonated overbased materials are those which the low molecular weight acidic material which is preferably used in the formation of the material is carbon dioxide. The preparation of overbased materials, including carbonated overbased materials, is well known and is described, in numerous United States patents including, for example, U.S. Pat. No. 3,766,067, McMillen.

The overbased materials can be borated or non-borated, as described below. The overbased materials (detergents) can also be a mixture of one or more borated detergents with one or more non-borated detergents. Borated overbased materials and their preparation are well known and are described in greater detail in European Patent Application 753,564, published Jan. 15, 1997 and in U.S. Pat. No. 4,792,410. In a preferred embodiment, the magnesium detergent is a borated magnesium sulfonate detergent.

Boronating agents include those described above in reference to the borated dispersants. An alkali metal borate dispersion can be prepared by the following steps: a suitable reaction vessel is charged with an alkaline metal carbonate overbased metal sulfonate within an oleophilic reaction medium (typically the hydrocarbon medium employed to prepare the overbased metal sulfonate). Boric acid is then charged to the reaction vessel and the contents vigorously agitated. The reaction is typically conducted for a period of 0.5 to 7 hours, usually from 1 to 3 hours at a reaction temperature of 20° C. to 200° C., preferably from 20° C. to 150° C., and more preferably from 40° C. to 125° C. At the end of the reaction period, the temperature is typically raised to 100° C. to 250° C., preferably from 100° C. to 150° C. to strip the medium of any residual alcohol and water. The stripping can be done at atmosphere pressure or under reduced pressure of, e.g., 93 kPa to 1 kPa.

The detergent, when it is borated, will preferably contribute 50 to 3000 parts per million (ppm) boron, more preferably 80 to 1500 ppm, and still more preferably 150, 200, 250, or 500 ppm to 1200 ppm boron, to the fully formulated fluid.

The amount of the calcium detergent can be 0.025 to 6 percent by weight, or 0.05 to 2 percent or to 1 percent by weight, or 0.1 to 1 percent by weight, or 0.1 to 0.4 percent by weight. The amount of the magnesium detergent can be 0.025 to 6 percent by weight, or 0.05 to 2 percent or to 1 percent by weight, or 0.1 to 1 percent by weight, or 0.1 to 0.4 percent by weight.

The amount of the borated additives, whether dispersants, detergents, or both, is preferably an amount suitable to provide friction and antiseizure properties similar to those achieved by the use of conventional zinc dialkyldithiophosphates. The preferred total amount of boron present in the fully formulated composition is at least 130 or 200 ppm, preferably at least 250 ppm, more preferably 400, to 3300 or to 2000 ppm, and even more preferably 600 or 700 ppm to 1700 or 1300 ppm.

The composition of the present invention also contains (e) an inorganic phosphorus compound, typically in an amount of 0.005 to 0.3 percent by weight, preferably 0.02 or 0.03 or 0.04 percent to 0.2 or 0.16 or 0.13 percent (e.g., 0.02 to 0.2 percent by weight).

The inorganic phosphorus compound may contain an oxygen atom and/or a sulfur atom as its constituent elements, and includes the followings examples: phosphorous acid, phosphoric acid, polyphosphoric acid, hypophosphoric acid, phosphorus trioxide, phosphorus tetroxide, phosphorous pentoxide, phosphorotetrathionic acid ($H_3PS_4$), phosphoromonothionic acid ($H_3PO_3S$), phosphorodithionic acid ($H_3PO_2S_2$), phosphorotrithionic acid ($H_3PO_2S_3$), and $P_2S_5$. Among these, phosphorous acid and phosphoric acid are preferred. A salt, such as an amine salt of an inorganic phosphorus compound can also be used. It is also possible to use a plurality of these inorganic phosphorus compounds together. The inorganic phosphorus compound is preferably phosphoric acid or phosphorous acid, preferably phosphoric acid, which is conventionally supplied as 85% aqueous phosphoric acid (i.e., 85% phosphoric acid (aqueous), the remaining 15% being water), for which the amount of phosphoric acid can be readily calculated. If the magnesium detergent (d) or the calcium detergent (c) is a borated species, relatively lower levels of the phosphorus acid (or other inorganic phosphorus compound) can be used (0.02 to 0.08 or 0.1 percent); otherwise, relatively higher levels can be preferred (0.08 or 0.1 to 0.2 percent).

The compositions of the present invention will generally contain other additives commonly used for ATFs or fluids for CVTs.

One common component for ATFs or CVT fluids is a viscosity modifier, ("VM," also referred to as a viscosity index improver). Viscosity modifiers are extremely well known in the art and most are commercially available. Hydrocarbon VMs include polybutenes, poly(ethylene/propylene) copolymers, and copolymers of styrene with butadiene or isoprene. Ester VMs include esters of styrene/maleic anhydride polymers, esters of styrene/maleic anhydride/acrylate terpolymers, and polymethacrylates. The acrylates are available from RobMax and from The Lubrizol Corporation, polybutenes from Ethyl Corporation and Lubrizol, ethylene/propylene copolymers from Exxon and Texaco, polystyrene/isoprene polymers from Shell, styrene/maleic esters from Lubrizol, and styrene/butadiene polymers from BASF.

The viscosity modifier can also be a dispersant viscosity modifier, prepared by reacting, in the presence of a free radical initiator, 55% to 99.9% by weight of an alkyl acrylate ester monomers containing 1 to 24 carbon atoms in the ester alkyl group, wherein at least 50 mole % of the esters contain at least 6 carbon atoms, preferably at least 8 carbon atoms, in the ester alkyl group, and 0.1% to 45% by weight, and in one embodiment 1.5 to 8% by weight of at least one nitrogen-containing monomer selected from the group consisting of vinyl substituted nitrogen heterocyclic monomers, dialkylaminoalkyl acrylate monomers, dialkylaminoalkyl acrylamide monomers, N-tertiary alkyl acrylamides, and vinyl substituted amines.

In one embodiment the dispersant viscosity modifier is prepared by polymerizing 57.5 parts methyl methacrylate, 12.7 parts butyl methacrylate, 226.5 parts each of $C_{9-11}$ methacrylate and $C_{12-15}$ methacrylate, 114.8 parts $C_{16-18}$ methacrylate and 11.7 parts N-(3-(dimethylamino)propyl) methacrylamide in a staged addition process. Details of the preparation of these and related polymers are found in European Patent Application 750,031, published Dec. 27, 1996.

The copolymers described above typically have a weight average molecular weight ($\overline{M}_w$) of 10,000 to 500,000, more often 30,000 to 250,000, frequently 20,000 to 100,000 and polydispersity values ($\overline{M}_w/\overline{M}_n$) of 1.2 to 5. Molecular weights of polymers are determined using well-known methods described in the literature.

Normally the amount of VM will be 1 to 25 percent by weight of the composition; preferably the amount will be 2 to 20 percent by weight, and more preferably 5 to 15 percent by weight.

Another common component for ATFs and CVT fluids is a phosphorus compound (other than inorganic phosphorus compound such as phosphoric acid, already described above), preferably (f) an organic phosphorus ester, amide, or amine salt. Most such phosphorus compounds impart a measure of anti-wear performance to the composition.

The phosphorus compound can be a phosphorus ester of the formula $(R^1X)(R^2X)P(X)_nX_mR^3$ or a salt thereof, where each X is independently an oxygen atom or a sulfur atom, n is 0 or 1, m is 0 or 1, m+n is 1 or 2, and $R^1$, $R^2$, and $R^3$ are hydrogen or hydrocarbyl groups. At least one of $R^1$, $R^2$, and $R^3$ is a hydrocarbyl group, and preferably at least one is hydrogen. This component thus includes phosphite esters, phosphate esters, and thiophosphite and thiophosphate esters. The esters can be mono-, di- or tri-hydrocarbyl esters. It is noted that certain of these materials can exist in tautomeric forms, and that all such tautomers are intended to be encompassed by the above formula and included within the present invention. For example certain phosphite esters can be written in at least two ways, $(RO)_2$—PH(═O) and $(RO)_2$—P—OH, differing merely by the placement of the hydrogen. Each of these structures are intended to be encompassed by the present invention.

The total number of carbon atoms in $R^1$, $R^2$ and $R^3$ in each of the above formula (for the phosphorus compound) should be sufficient to render the compound soluble in the medium. Generally, the total number of carbon atoms in $R^1$, $R^2$ and $R^3$ is at least 8, and in one embodiment at least 12, and in one embodiment at least 16. There is no limit to the total number of carbon atoms in $R^1$, $R^2$ and $R^3$ that is required, but a practical upper limit is 400 or 500 carbon atoms. In one embodiment, $R^1$, $R^2$ and $R^3$ in the above formula are independently hydrocarbyl groups of preferably 1 to 100 carbon atoms, or 1 to 50 carbon atoms, or 1 to 30 carbon atoms. Each $R^1$, $R^2$ and $R^3$ can be the same as the other, although they may be different. Examples of useful $R^1$, $R^2$ and $R^3$ groups include hydrogen, t-butyl, isobutyl, amyl, isooctyl, decyl, dodecyl, oleyl, $C_{18}$ alkyl, eicosyl, 2-pentenyl, dodecenyl, phenyl, naphthyl, alkylphenyl, alkylnaphthyl, phenylalkyl, naphthylalkyl, alkylphenylalkyl, and alkylnaphthylalkyl.

It is preferred that at least two of the X atoms in the above structure are oxygen, so that the structure will be $(R^1O)(R^2O)P(X)_nX_mR^3$, and more preferably $(R^1O)(R^2O)P(X)_nX_mH$.

The $R^1$ and $R^2$ groups can comprise a mixture of hydrocarbyl groups derived from commercial alcohols. Examples of some preferred monohydric alcohols and alcohol mixtures include the commercially available Alfol™ alcohols marketed by Continental Oil Corporation. Alfol™ 810, for instance, is a mixture containing alcohols consisting essentially of straight-chain primary alcohols having from 8 to 10 carbon atoms. Another commercially available alcohol mixture is Adol™ 60 which comprises about 75% by weight of a straight-chain $C_{22}$ primary alcohol, about 15% of a $C_{20}$ primary alcohol, and about 8% of $C_{18}$ and $C_{24}$ alcohols. The Adol™ alcohols are marketed by Ashland Chemical.

A variety of mixtures of monohydric fatty alcohols derived from naturally occurring triglycerides and ranging in chain length from $C_8$ to $C_{18}$ are available from Procter & Gamble Company. Another group of commercially available mixtures include the Neodol™ products available from Shell Chemical Co. Other alcohols which can be used are lower molecular weight alcohols such as methanol, ethanol, propanol, isopropanol, normal butanol, isobutanol, tertbutanol, the pentanols, hexanols, heptanols, octanols (including 2-ethyl hexanol), nonanols, decanols, and mixtures thereof.

The dihydrocarbyl hydrogen phosphites, such as dibutyl hydrogen phosphite, useful in this invention can be prepared by techniques well known in the art, and many such phosphites are available commercially.

In one embodiment, the phosphorus-containing agent is a hydrocarbyl phosphate. In another embodiment, the hydrocarbyl phosphate can be a hydrocarbyl thiophosphate. In yet another embodiment, the phosphorus compound can be a phosphorus-containing amide. Phosphorus-containing amides are generally prepared by reacting one of the above-described phosphorus acids such as a phosphoric, phosphonic, phosphinic, thiophosphoric, including dithiophosphoric as well as monothiophosphoric, thiophosphinic or thiophosphonic acids with an unsaturated amide, such as an acrylamide.

Examples of phosphorus-containing materials are phosphites and phosphates such as dibutyl phosphite, diphenylphosphite, triphenylphosphite, tricresylphosphate and triphenylthiophosphate.

The amount of the phosphorus containing compound or compounds (especially the organic phosphorus ester (f)) in the fully formulated fluids of the present invention (other than the inorganic phosphorus compound of (e)), will typically be 0.01 to 6 percent by weight or 0.02 to 2 percent or 0.03 to 1 percent, or 0.04 to 0.5 percent by weight. Alternative amounts include 0.05 to 5 percent by weight, preferably 0.1 to 2 percent, and more preferably 0.2 to 1 percent by weight. The amount of such compounds will depend to some extent on the specific compound, its molecular weight, phosphorus content, and activity. Thus, the amount of the organic phosphorus ester (f) can also be described as an amount sufficient to contribute 0.005 to 2 percent phosphorus to the composition, preferably 0.006 to 1 percent P or 0.007 to 0.5 or 0.1 percent P. Typically the fully formulated fluids of the present invention will contain 150 to 1000 parts per million phosphorus, preferably 300 to 500 ppm phosphorus from all sources.

Another common component of ATFs and CVT fluids is one or more friction modifiers. Friction modifiers are very well known in the art, and the number and types of compounds are voluminous. In general, friction modifiers include metal salts of fatty acids, fatty phosphites, fatty acid amides, fatty epoxides and borated derivatives thereof, fatty amines, glycerol esters and their borated derivatives, alkoxylated fatty amines (including ethoxylated fatty amines such as diethoxylated tallowamine) and their borated derivatives, isostearic acid condensation products of polyamines such as tetraethylene pentamine, such condensates containing amide and imidazoline or imine functional groups, (including also N-hydroxyethyl oleylimidazoline and low molecular weight alkenylsuccinimides), sulfurized olefins, sulfurized polyolefins, sulfurized fats, and sulfurized fatty acids. They can also be suspended molybdenum disulfide, dialkyl or diaryl dithiophosphate molybdates or alkyl or dialkyl dithiocarbamate molybdates where the molybdenum is oxydisulfidobridged and chelated with dithiophosphate or dithiocarbamate ligands.

The amount of the friction modifier component, if present, can be 0.01 to 2.5 percent by weight of the composition, preferably 0.025 to 1.00 percent, more preferably 0.1 to 0.45 percent, 0.15 to 0.3 percent, or 0.2 to 0.25 percent by weight. The total amount of the friction modifiers (of all types) is preferably that which provides a metal-to-metal coefficient of friction of at least 0.120 as measured at 110° C. by ASTM-G-77, using the composition as a lubricant, since such minimum friction is desirable for the presently contemplated application. Preferably the amount of friction modifiers is sufficient to provide a coefficient of friction of 0.125 to 0.145 or 0.142, and more preferably about 0.135.

Other materials often used in ATFs and CVT fluids include antioxidants, including hindered phenolic antioxidants, secondary aromatic amine antioxidants, sulfurized phenolic antioxidants, oil-soluble copper compounds, phosphorus-containing antioxidants, organic sulfides, disulfides, and polysulfides. Other components include metal deactivators such as tolyltriazole, benzotriazole, and the methylene-coupled product of tolyltriazole and amines such as 2-ethylhexylamine. Such metal deactivators can also be useful in adjusting the metal-to-metal friction in push belt CVTs. Other components can include seal swell compositions, such as isodecyl sulfolane (that is, isodecyl-3-sulfolanyl ether), which are designed to keep seals pliable. Also permissible are pour point depressants, such as alkylnaphthalenes, polymethacrylates, vinyl acetate/fumarate or /maleate copolymers, and styrene/maleate copolymers. These optional materials are known to those skilled in the art, are generally commercially available, and are described in greater detail in published European Patent Application 761,805. Also included can be corrosion inhibitors, dyes, fluidizing agents, and antifoam agents. Each of these materials may be present in conventional and functional amounts.

The various components which can be used in the present invention are described in greater detail in PCT Patent Application WO 00/70001.

The composition of the present invention can be supplied as a fully formulated lubricant or functional fluid, or it can be supplied as a concentrate. In a concentrate, the relative amounts of the various components will generally be about the same as in the fully formulated composition, except that the amount of oil of lubricating viscosity will be decreased by an appropriate amount. The absolute percentage amounts of the remaining components will be correspondingly increased. Thus, when the concentrate is added to an appropriate amount of oil, the final formulation of the present invention will be obtained. A typical concentrate of the present invention may contain at least 2500 parts per million of boron.

Thus, in a fully formulated composition, the amount of the oil of lubricating viscosity will typically be a major amount, or 50 to 95 parts by weight. In a concentrate, similarly, the amount of the oil of lubricating viscosity will typically be 10 to 50 parts by weight or 10 to 50 percent, or other intermediate values that may be appropriate. Other amounts of the various components may be independently selected from a consideration of the broad, preferred, and most preferred percent ranges of such components set forth above. In one embodiment, the relative weight ratios of components (b, the borated succinimide dispersant) to (c, the calcium detergent) to (d, the magnesium detergent) to (e, the phosphoric acid) are about (1 to 4) to (0.05 to 1) to (0.05 to 1) to (0.02 to 2).

In one preferred embodiment, the present invention provides a composition suitable for use as a lubricant for a transmission, comprising:

(a) an oil of lubricating viscosity;

(b) 1 to 4 percent by weight of a borated succinimide dispersant, said borated succinimide dispersant being the reaction product of a polyisobutenylsuccinic anhydride with polyethyleneamines, further reacted with boric acid; wherein said borated succinimide dispersant contributes 50 to 3000 parts per million by weight boron to the composition;

(c) 0.1 to 1 percent by weight of an overbased calcium alkylbenzenesulfonate detergent having a metal ratio of about 4:1 to about 25:1;

(d) 0.1 to 1 percent by weight of an overbased magnesium alkylbenzenesulfonate detergent having a metal ratio of 4:1 to 25:1;

(e) 0.01 to 0.2 percent by weight of phosphoric acid as 85% phosphoric acid (aqueous); and (f) 0.2 to 2 percent by weight of a dialkyl hydrogen phosphite;

wherein said composition contains 130 to 3300 parts per million by weight boron.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

Example 1. A formulation is prepared containing 100 parts by weight of an API Group III base stock having a viscosity of 3.7-3.8 cSt at 100° C.; 2.55 parts borated succinimide dispersant based on polyisobutenylsuccinic anhydride reacted with polyethyleneamines, containing 1.9% B, 67% active chemical and 33% diluent oil; 0.2 parts overbased calcium sulfonate detergent based on a formaldehyde-coupled polypropylene-substituted sulfonic acid, 300 Total Base Number (TBN), 58% active chemical and 42% diluent oil; 0.2 parts overbased magnesium alkaryl sulfonate detergent, 400 TBN, 58% active chemical and 42% diluent oil; and 0.16 parts 85% phosphoric acid. The overbased detergents are commercial carbonated materials, which may contain small amounts of dispersants and other conventional components. In addition, the formulation contains 0.05 parts dibutyl hydrogen phosphite, 0.03 parts of a commercial antifoam agent, 0.05 parts additional diluent oil, and 10 parts dispersant viscosity modifier, based on a methacrylate copolymer with amine functionality (74 percent polymer, 26 percent diluent oil).

Example 2. A formulation is prepared as in Example 1, except that the magnesium detergent is replaced by 0.19 parts of a similar borated magnesium sulfonate detergent, 3.8% B, 295 TBN, 61% active chemical, 39% diluent oil; and the amount of the 85% phosphoric acid is reduced to 0.05 parts. Both of the formulations are tested and found to have a dynamic metal-on-metal coefficient of friction of greater than 0.130 (500 mm/s sliding speed) as well as a plot of metal-on-metal coefficient of friction that exhibits a positive slope over the range of 20-1000 mm/s.

Example 3. A formulation is prepared as in Example 1, except that the magnesium detergent is replaced by 0.23 parts of an overbased magnesium alkyl-substituted phenate, TBN 69, including 50% diluent oil, and the calcium detergent is replaced by 0.19 parts of an overbased calcium alkyl-substituted salicylate, TBN 165, including 40% diluent oil. The formulation exhibits a high dynamic metal-on-metal coefficient of friction.

Examples 4-11. To the formulation of Example 1 is added 0.5 parts by weight (active chemical basis) of each of the following materials, in turn:

(4) A Mannich condensation product of a branched alkyl-substituted phenol, formaldehyde, and diethanolamine.
(5) A formaldehyde-coupled linear alkyl-substituted phenol.
(6) The condensation product of a linear alkyl-substituted succinic anhydride with diethanolamine.
(7) A polyisobutene substituted succinic anhydride
(8) A triphenyl thiophosphate
(9) A di(long chain alkyl) phosphite
(10) N-phenyl alpha-naphthylamine
(11) A sulfurized vegetable oil, optionally including also a sulfurized olefin.

Examples 12-15. A formulation is prepared as in Example 1, except that the magnesium detergent and/or the calcium detergent are replaced in turn by corresponding amounts of the following magnesium and/or calcium detergents, respectively:

(12) An overbased calcium alkylphenate, sulfurized
(13) An overbased calcium sulfonate, borated
(14) An overbased magnesium alkylphenate
(15) An overbased magnesium alkylphenate and an overbased calcium salt of the reaction product of alkylphenol and glyoxylic acid.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A method for lubricating a continuously variable transmission which comprises a metal-on-metal contact, comprising supplying to said transmission a composition comprising:

(a) an oil of lubricating viscosity;
(b) a dispersant;
(c) a calcium detergent;
(d) a magnesium detergent; and
(e) an inorganic phosphorus compound;

wherein at least one of (b), (c), and (d) is borated; and wherein said composition provides a metal-to-metal dynamic coefficient of friction of at least 0.120.

2. The method of claim 1 wherein the dispersant is a borated succinimide dispersant.

3. The method of claim 1 wherein the dispersant is present in an amount of about 0.5 to about 6 percent by weight.

4. The method of claim 1 wherein the dispersant contributes about 50 to about 3000 parts per million by weight boron to the composition.

5. The method of claim 1 wherein the calcium detergent is an overbased calcium hydrocarbylbenzenesulfonate or an overbased calcium hydro-carbylsalicylate.

6. The method of claim 1 wherein the amount of the calcium detergent is about 0.025 to about 6 weight percent.

7. The method of claim 1 wherein the magnesium detergent is an overbased magnesium hydrocarbylbenzenesulfonate or an overbased magnesium hydrocarbylphenate.

8. The method of claim 1 wherein the amount of the magnesium detergent is about 0.025 to about 6 weight percent.

9. The method of claim 1 wherein at least one of the calcium detergent and the magnesium detergent is borated.

10. The method of claim 1 wherein the composition contains about 130 to about 3300 parts per million by weight boron.

11. The method of claim 1 wherein the inorganic phosphorus compound is phosphoric acid or phosphorous acid.

12. The method of claim 1 wherein the composition further comprises (f) about 0.01 to about 6 weight percent of an organic phosphorus ester.

13. A method for lubricating a continuously variable transmission which comprises a metal-on-metal contact, comprising supplying to said transmission a composition comprising:

(a) an oil of lubricating viscosity;

(b) a dispersant;

(c) a calcium detergent;

(d) a magnesium detergent; and (e) about 0.005 to about 0.3 percent by weight of an inorganic phosphorus compound comprising phosphoric acid or phosphorous acid;

wherein at least one of (b), (c), and (d) is borated; and wherein said composition provides a metal-to-metal dynamic coefficient of friction of at least 0.120.

* * * * *